US008672655B2

(12) United States Patent
Kim et al.

(10) Patent No.: US 8,672,655 B2
(45) Date of Patent: Mar. 18, 2014

(54) SCROLL COMPRESSOR HAVING A PASS HOLE FOR PREVENTING OVER-COMPRESSION UNDER A LOW LOAD CONDITION

(76) Inventors: Jeonghun Kim, Changwon (KR); Junghoon Park, Changwon (KR); Sungsoon Jang, Changwon (KR); Nara Han, Changwon (KR)

( * ) Notice: Subject to any disclaimer, the term of this patent is extended or adjusted under 35 U.S.C. 154(b) by 303 days.

(21) Appl. No.: 13/149,223

(22) Filed: May 31, 2011

(65) Prior Publication Data

US 2011/0318211 A1 Dec. 29, 2011

(30) Foreign Application Priority Data

Jun. 24, 2010 (KR) ..... 10-2010-0060212

(51) Int. Cl.
*F01C 1/02* (2006.01)
*F03C 2/00* (2006.01)
*F04C 2/00* (2006.01)

(52) U.S. Cl.
USPC ..... 418/55.1; 418/15; 418/55.5; 418/57; 418/180

(58) Field of Classification Search
USPC ..... 418/15, 180, 55.1–55.6, 57, 270; 417/299, 307, 310
See application file for complete search history.

(56) References Cited

U.S. PATENT DOCUMENTS

| | | | | |
|---|---|---|---|---|
| 4,774,816 | A * | 10/1988 | Uchikawa et al. | 418/55.1 |
| 4,818,195 | A * | 4/1989 | Murayama et al. | 418/55.1 |
| 6,478,556 | B2 * | 11/2002 | Choi et al. | 418/55.2 |
| 6,672,845 | B1 * | 1/2004 | Kim et al. | 417/310 |
| 6,881,046 | B2 * | 4/2005 | Shibamoto et al. | 418/55.2 |
| 2008/0175738 | A1 | 7/2008 | Jung et al. | |

FOREIGN PATENT DOCUMENTS

| | | |
|---|---|---|
| CN | 1314899 C | 5/2007 |
| CN | 101037995 A | 9/2007 |
| JP | 2005-171911 | 6/2005 |

OTHER PUBLICATIONS

Chinese Office Action dated Jul. 2, 2013 and English language translation.

* cited by examiner

*Primary Examiner* — Theresa Trieu
(74) *Attorney, Agent, or Firm* — KED & Associates LLP

(57) ABSTRACT

In a scroll compressor, a pass hole is formed at a position overlapping with a discharge sector of a discharge hole, where a sector for passing a refrigerant through the pass hole is overlapped with a sector for discharging the refrigerant through a discharge hole. This may prevent over-compression of a refrigerant when the scroll compressor is driven at a low speed. This may enhance efficiency of the scroll compressor in a low speed driving mode and under a low load condition.

13 Claims, 6 Drawing Sheets

| | Unit | 67Hz | | 45Hz | | 30Hz | |
|---|---|---|---|---|---|---|---|
| | | A | B | B1 | F1 | B2 | F2 |
| Cond. Temp | ℃ | 45.4 | 38.4 | 36.1 | 26.9 | 34.9 | 26.7 |
| Cond. Pressure | ~~kgf/㎠ A~~ | ~~28.09~~ | ~~23.74~~ | ~~22.41~~ | ~~17.76~~ | ~~21.75~~ | ~~17.66~~ |
| | MPa A | 2.7546 | 2.3279 | 2.1976 | 1.7419 | 2.1335 | 1.7315 |
| | PSIG | 384.9 | 323 | 304.1 | 238 | 294.8 | 236.5 |
| Eva. Temp | ℃ | 10.4 | 9.8 | 11.2 | 10.5 | 13.0 | 12.4 |
| Eva. Pressure | ~~kgf/㎠ A~~ | ~~11.20~~ | ~~11.01~~ | ~~11.47~~ | ~~11.22~~ | ~~12.08~~ | ~~11.88~~ |
| | MPa A | 1.0979 | 1.0800 | 1.1248 | 1.1007 | 1.1848 | 1.1648 |
| | PSIG | 144.6 | 142 | 148.5 | 145 | 157.2 | 154.3 |
| Presure Ratio | | **2.51** | **2.16** | **1.95** | **1.58** | **1.80** | **1.49** |

SCROLL COMPRESSOR HAVING A PASS HOLE FOR PREVENTING OVER-COMPRESSION UNDER A LOW LOAD CONDITION

CROSS-REFERENCE TO RELATED APPLICATION

Pursuant to 35 U.S.C. §119(a), this application claims the benefit of earlier filing date and right of priority to Korean Application No. 10-2010-0060212, filed on Jun. 24, 2010, the content of which is incorporated by reference herein in its entirety.

BACKGROUND OF THE DISCLOSURE

1. Field of the Disclosure

The present disclosure relates to a scroll compressor, and particularly, to an inverter type scroll compressor.

2. Background of the Disclosure

A scroll compressor is an apparatus for compressing a refrigerant gas by changing a volume of a compression chamber formed by a pair of scrolls facing each other. When compared with a reciprocating compressor or a rotary compressor, the scroll compressor has higher efficiency, lower vibration and noise, a smaller size and a lighter weight. Accordingly, the scroll compressor is being widely applied to an air conditioning system.

The scroll compressor may be categorized into a constant speed type scroll compressor and an inverter type scroll compressor according to a driving method of a driving motor. The constant speed type scroll compressor indicates a compressor having the same driving speed regardless of a load change, whereas the inverter type scroll compressor indicates a compressor having a driving speed variable according to a load change.

The constant speed type scroll compressor is designed to have a pressure ratio which can minimize an over-compression loss under any load condition of a refrigerating cycle apparatus.

However, the conventional constant speed type scroll compressor may have the following problems. That is, the conventional constant speed type scroll compressor has a small over-compression loss under a load condition of a refrigerating cycle apparatus. On the other hand, the conventional constant speed type scroll compressor has a large over-compression loss under a low load condition of a refrigerating cycle apparatus. Accordingly, if the inverter type scroll compressor is designed to have the same pressure ratio as that of the constant speed type scroll compressor, the efficiency of the compressor is degraded under a low load. That is, since the inverter type scroll compressor has a driving speed variable according to a load change, a design degree of freedom of a pressure ratio is higher than that of the constant speed type scroll compressor. However, when the inverter type scroll compressor is designed to have the same pressure ratio as that of the constant speed type scroll compressor, an over-compression occurs under a low load condition to degrade the efficiency of the compressor.

SUMMARY OF THE DISCLOSURE

Therefore, an object of the present disclosure is to provide a scroll compressor having a proper pressure ratio such that an over-compression does not occur even under a low load condition.

To achieve these and other advantages and in accordance with the purpose of the present disclosure, as embodied and broadly described herein, there is provided a scroll compressor having wraps such that a plurality of scrolls are engaged with each other, and forming a compression chamber consecutively moveable as one of the scrolls performs an orbiting motion, wherein a ratio (Pd/Ps) of a discharge pressure (Pd) of a refrigerant discharged from the compression chamber with respect to a suction pressure (Ps) of the refrigerant sucked into the compression chamber is in the range of 1.5~1.8.

According to another aspect of the present disclosure, there is provided a scroll compressor having wraps such that a plurality of scrolls are engaged with each other, forming a compression chamber consecutively moveable as one of the scrolls performs an orbiting motion, and having a pass hole formed such that a refrigerant compressed in the compression chamber is partially passed to outside of the compression chamber before reaching a discharge hole, wherein the pass hole is formed at a position where a sector for passing the refrigerant through the pass hole is overlapped with a sector for discharging the refrigerant through the discharge hole.

According to still another aspect of the present disclosure, there is provided a scroll compressor including a hermetic container, a driving motor installed at an inner space of the hermetic container, a fixed scroll fixedly coupled to an inner circumferential surface of the hermetic container at one side of the driving motor, and having a wrap of a preset height on one side surface thereof, an orbiting scroll having a wrap of a preset height on one side surface thereof so as to be engaged with the wrap of the fixed scroll, performing an orbiting motion with respect to the fixed scroll by being eccentrically coupled to a crank shaft with respect to a rotation center of the driving motor, and forming a compression chamber which consecutively moves between the wraps, and a sliding member configured to vary an orbiting radius of the orbiting scroll, wherein the fixed scroll is provided with a pass hole formed such that a refrigerant compressed in the compression chamber is partially passed to outside of the compression chamber before reaching a discharge hole, wherein the pass hole is formed at a position where a sector for passing the refrigerant through the pass hole is overlapped with a sector for discharging the refrigerant through the discharge hole.

The foregoing and other objects, features, aspects and advantages of the present disclosure will become more apparent from the following detailed description of the present disclosure when taken in conjunction with the accompanying drawings.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain the principles of the disclosure.

In the drawings.

DETAILED DESCRIPTION OF THE DISCLOSURE

Description will now be given in detail of the present disclosure, with reference to the accompanying drawings.

For the sake of brief description with reference to the drawings, the same or equivalent components will be provided with the same reference numbers, and description thereof will not be repeated.

Hereinafter, a scroll compressor according to the present disclosure will be explained in more detail with reference to the attached drawings.

Figure 1:
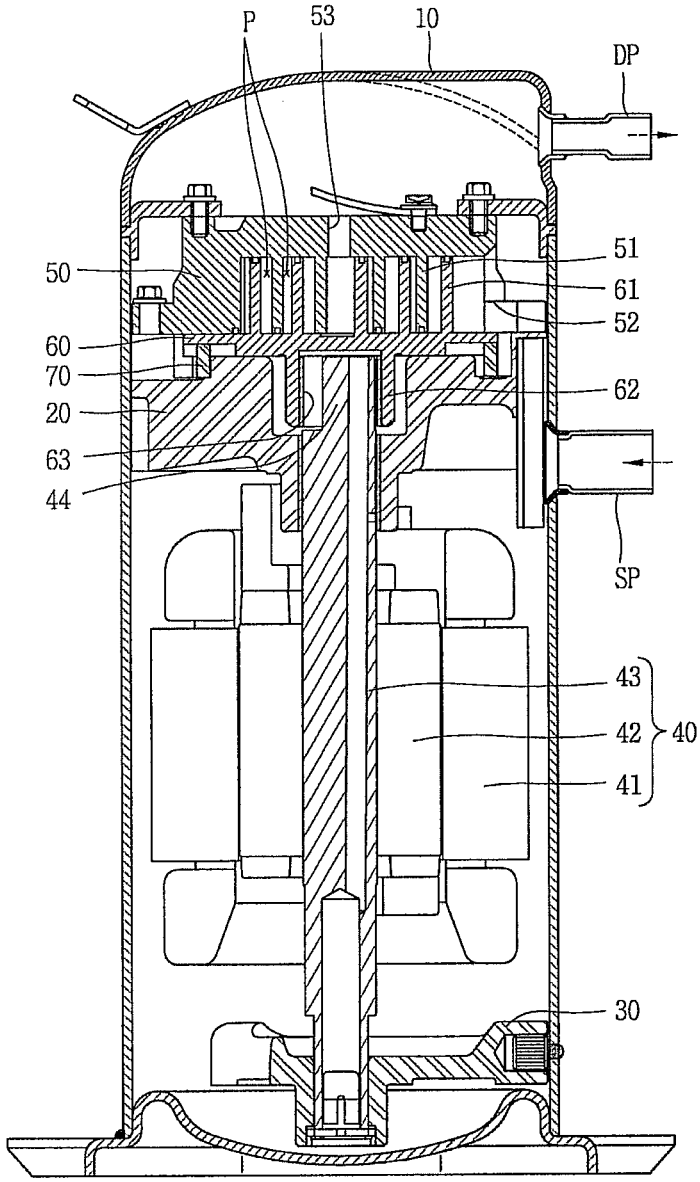
FIG. 1 is a longitudinal sectional view showing a radius variable type scroll compressor according to the present disclosure.
Figure 2:
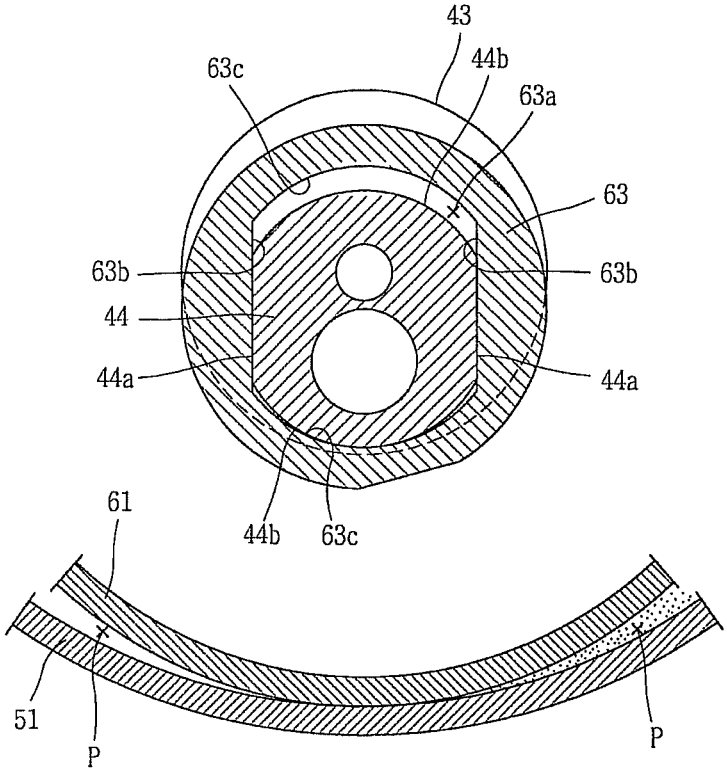
FIGS. 2 and 3 are views schematically showing a sealing state and a leakage state in a radial direction in the scroll compressor of FIG. 1.
Figure 3:
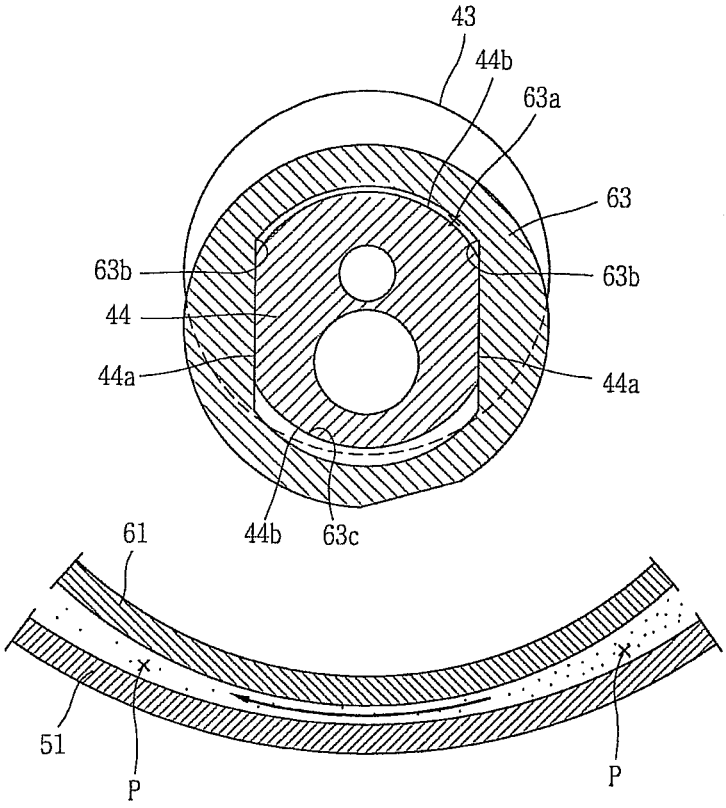

FIG. 1 is a longitudinal sectional view showing a radius variable type scroll compressor according to the present disclosure, and FIGS. 2 and 3 are views schematically showing a sealing state and a leakage state in a radial direction in the scroll compressor of FIG. 1.

As shown in FIGS. 1 to 3, the scroll compressor according to the present disclosure includes a hermetic container 10, a main frame 20 and a sub frame 30 installed in the hermetic container 10, a driving motor 40, a driving force transmission part installed between the main frame 20 and the sub frame 30, and a compression mechanical part consisting of a fixed scroll 50 and an orbiting scroll 60, disposed above the main frame 20 and configured to compress a refrigerant by being coupled to the driving motor 40.

The driving motor 40 includes a stator 41 on which a coil is wound, a rotor 42 rotatably inserted into the stator 41, and a crank shaft 43 forcibly inserted into the center of the rotor 42 and configured to transmit a rotation force to the compression mechanical part. A driving pin 44 is protruding from an upper end of the crank shaft 43 so as to be eccentric from the rotation center of the crank shaft.

The driving pin 44 is formed to have a rectangular shape, and two side surfaces 44*a* of the driving pin 44 are formed to be planar so as to slidably contact sliding surfaces 63*b* of a sliding bush 63 to be later explained. And, front and rear surfaces 44*b* of the driving pin 44, i.e., two surfaces where the sliding bush 63 is slid are formed to be curved. The front and rear surfaces 44*b* of the driving pin 44 may be formed to be planar. However, when edges of the driving pin 44 connected to two side surfaces 44*a* are formed to be angular, abrasion may occur at a sliding recess 63*a* of the sliding bush 63. Accordingly, it is preferable to form the edges of the driving pin 44 in a curved shape when both of the front and rear surfaces of the driving pin 44 are formed to be curved or planar.

The compression mechanical part includes a fixed scroll 50 fixed to an upper surface of the main frame 20, an orbiting scroll 60 disposed on an upper surface of the main frame 20 so as to be engaged with the fixed scroll 50, and an Oldham's ring 70 disposed between the orbiting scroll 60 and the main frame 20, and configured to prevent a rotation of the orbiting scroll 60.

A fixed wrap 51 which forms a compression chamber (P) together with an orbiting wrap 61 to be later explained by being spirally wound is formed on the fixed scroll 50. The orbiting wrap 61 which forms a compression chamber (P) by being engaged with the fixed wrap 51 by being spirally wound is formed on the orbiting scroll 60. A boss portion 62 coupled to the crank shaft 43 and receiving a rotation force is protruding from a bottom surface of the orbiting scroll 60, i.e., an opposite side surface to the orbiting wrap 61.

The sliding bush 63 slidably coupled to the driving pin 44 of the crank shaft 43 in a radius direction is slidably coupled to the boss portion 62 of the orbiting scroll 60 in a rotation direction. An outer diameter of the sliding bush 63 is formed to be approximately same as an inner diameter of the boss portion of the orbiting scroll 60, and a sliding recess 63*a* having a rectangular shape is formed at a central portion of the sliding bush 63 such that the driving pin 44 of the crank shaft 43 is slid in a radius direction.

The sliding recess 63*a* is formed to have the same shape and length as those of the driving pin 44, approximately. Two sliding surfaces 63*b* of the sliding recess 63*a* are formed to be planar like the two side surfaces 44*a* of the driving pin 44. On the other hand, front and rear stopper surfaces 63*c* of the sliding recess 63*a* are formed to be curved or planar like the front and rear surfaces 44*b* of the driving pin 44.

Unexplained reference numeral 52 indicates a suction hole, 53 indicates a discharge hole, SP indicates a suction pipe, and DP indicates a discharge pipe.

The operation and effect of the scroll compressor according to the present disclosure will be explained as follows.

More concretely, once the crank shaft 43 is rotated as power is applied to the driving motor 40, the orbiting scroll 60 eccentrically-coupled to the crank shaft 43 performs an orbiting motion along a predetermined orbit. Here, the compression chamber (P) formed between the orbiting scroll 60 and the fixed scroll 50 is consecutively moved towards the center of an orbiting motion to have a decreased volume, thereby consecutively sucking, compressing and discharging a refrigerant.

This will be explained in more details. When the compressor is initially driven as shown in FIG. 2, a gas force of the compression chamber (P) is lower than a centrifugal force of the orbiting scroll 60. Accordingly, the orbiting scroll 60 tends to move to outside by the centrifugal force. As the sliding bush 63 coupled to the orbiting scroll 60 is slidably coupled to the driving pin 44 of the crank shaft 40, the orbiting scroll 60 is slidably moved in a centrifugal direction, i.e., an eccentric direction of the driving pin 44. During this process, the orbiting wrap 61 of the orbiting scroll 60 contacts the fixed wrap 51 of the fixed scroll 50 to stably form the compression chamber (P), and consecutively moves towards the center.

When the driving motor performs a high speed driving (e.g., speed more than 35 Hz), the centrifugal force of the orbiting scroll 60 is increased to increase an orbiting radius of the orbiting scroll 60. As a result, the orbiting wrap 61 is more closely adhered to the fixed wrap 51 to minimize leakage of a refrigerant in a radius direction, thereby enhancing a function of the compressor. However, when the centrifugal force of the orbiting scroll 60 is more than a predetermined level, the orbiting wrap 61 is excessively adhered to the fixed wrap 51. This may increase a frictional loss when the amount of oil to be supplied is deficient, or may damage the wraps.

When the orbiting wrap 61 is to be excessively adhered to the fixed wrap 51 as the centrifugal force of the orbiting scroll 60 is increased, the gas force of the compression chamber (P) generates a repulsive force. By this repulsive force, the orbiting scroll 60 receives a force in a centripetal force direction. Then, the orbiting scroll 60 receives a centripetal force, and the orbiting wrap 61 is moved to a direction spacing from the fixed wrap 51 by the sliding bush 63 and the driving pin 44 of the crank shaft 43. As a result, leakage of a refrigerant occurs in a radius direction, and thus a frictional loss between the orbiting wrap 61 and the fixed wrap 51 is reduced.

On the other hand, when the driving motor 40 performs a low speed driving (e.g., speed less than 35 Hz), the centrifugal force of the orbiting scroll 60 is small to decrease an orbiting radius of the orbiting scroll 60. Accordingly, the orbiting wrap 61 is separated from the fixed wrap 51, and thus leakage of a refrigerant may occur in a radius direction. In order to maintain a pressure ratio of the compression chamber by a predetermined degree even in a low speed driving mode, starting angles and ending angles of the scrolls may be controlled. However, when a pressure ratio of an inverter type scroll compressor is designed to be the same as that of a constant speed type scroll compressor, the efficiency of the compressor may be lowered under a low load condition. The present disclosure is to set a position of a pass hole so as to have a proper pressure ratio which does not cause the occurrence of an over-compression even under a low load condition.

Figure 4:
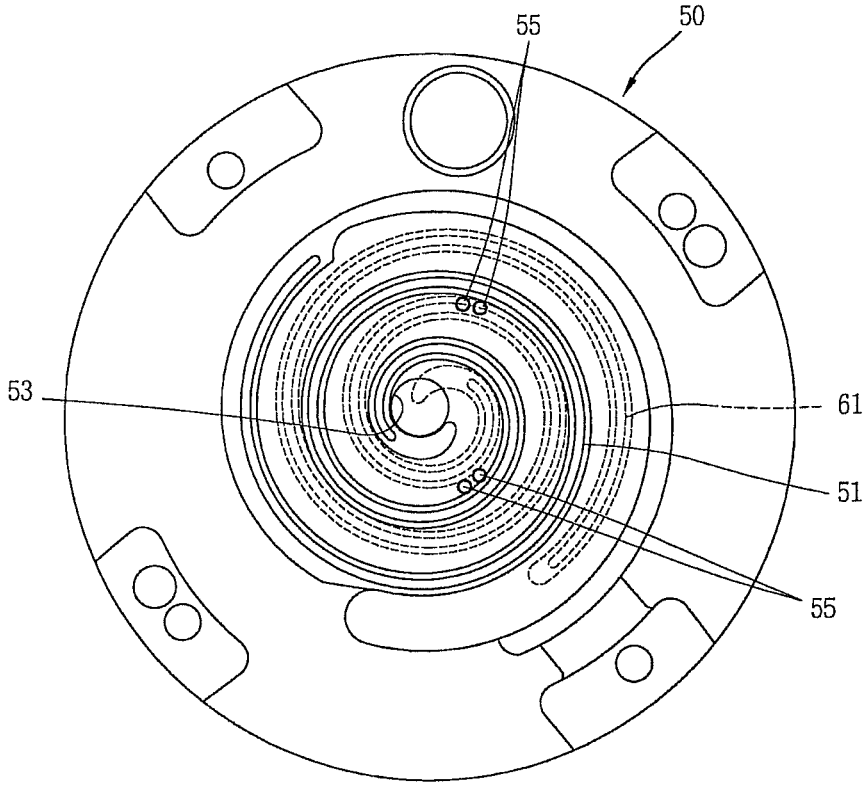
FIG. 4 is a planar view of a fixed scroll for explaining a position of a pass hole in the scroll compressor of FIG. 1.

Referring to FIG. 4, a pass hole 55 for partially passing a refrigerant compressed in an intermediate part on an orbit of the compression chamber (P) is formed at the fixed scroll 50. The pass hole 55 is formed to correspond to each of the two compression chambers (P). The pass hole 55 is formed to have a diameter smaller than a width of the orbiting wrap 61 such that a refrigerant is not leaked between an inner compression chamber and an outer compression chamber.

Preferably, the pass hole 55 is formed at a position where a pressure ratio of the compression chamber is in the range of 1.5~1.8, approximately, i.e., at a position where a ratio (Pd/Ps) of a discharge pressure (Pd) of a refrigerant discharged from the compression chamber with respect to a suction pressure (Ps) of the refrigerant sucked into the compression chamber is in the range of 1.5~1.8. More concretely, the pass hole 55 is formed at a position where a sector for passing the refrigerant through the pass hole 55 is overlapped with a sector for discharging the refrigerant through the discharge hole 53.

Figure 5:
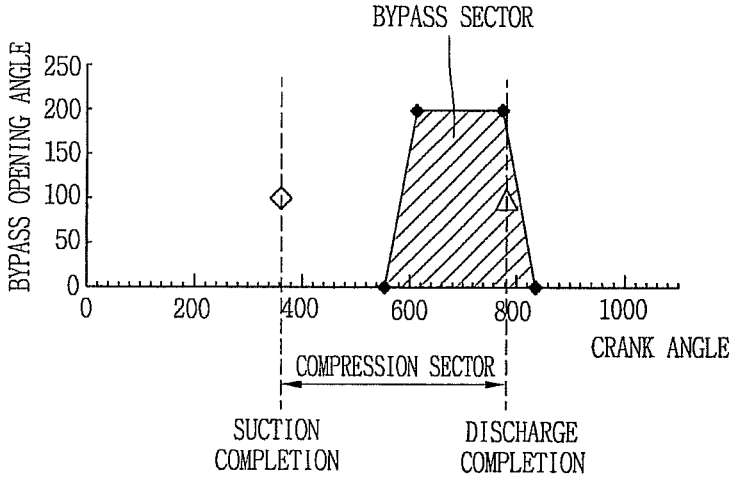
FIGS. 5 and 6 are views schematically showing opening and closing sectors of the pass hole of FIG. 4.

The pass hole 55 may be formed so as to be open at an angle of about 150°~250° based on a suction completion time point (i.e., compression starting angle), and so as to be closed at about 450°~550° based on the suction completion time point. More concretely, as shown in FIG. 5, when the compression chamber is formed at an outer side of the orbiting wrap 61, a crank angle may be formed to be open at about 560°, but to be closed at about 820°. On the other hand, referring to FIG. 6, when the compression chamber is formed at an inner side of the orbiting wrap 61, the crank angle may be formed to be open at about 400°, but to be closed at about 720°.

Figures 6, 7:
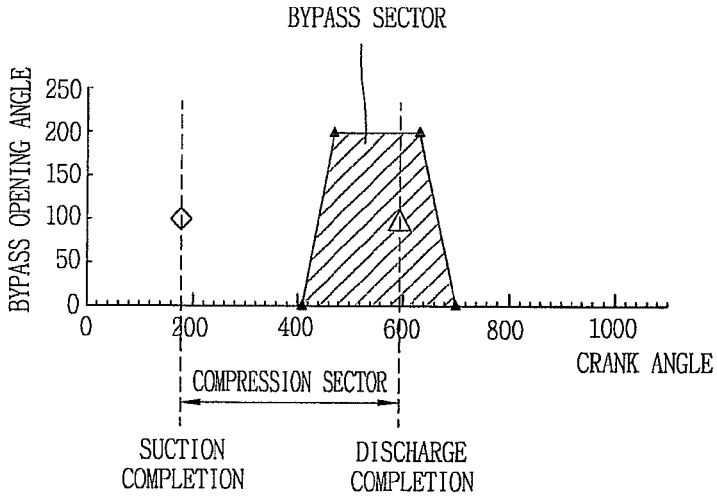
FIG. 7 is a condition table for experimenting on an over-compression loss of the scroll compressor having a pass hole of FIG. 4.
Figure 8:
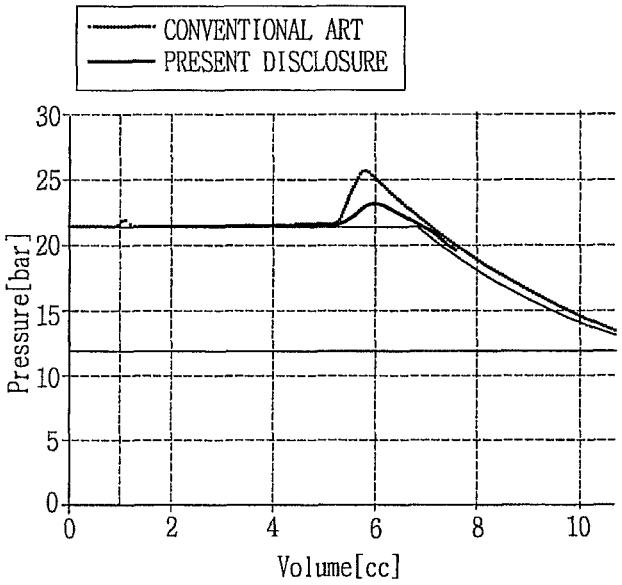
FIGS. 8 and 9 are graphs comparing an over-compression loss under conditions of FIG. 7 with that of the conventional art.
Figure 9:
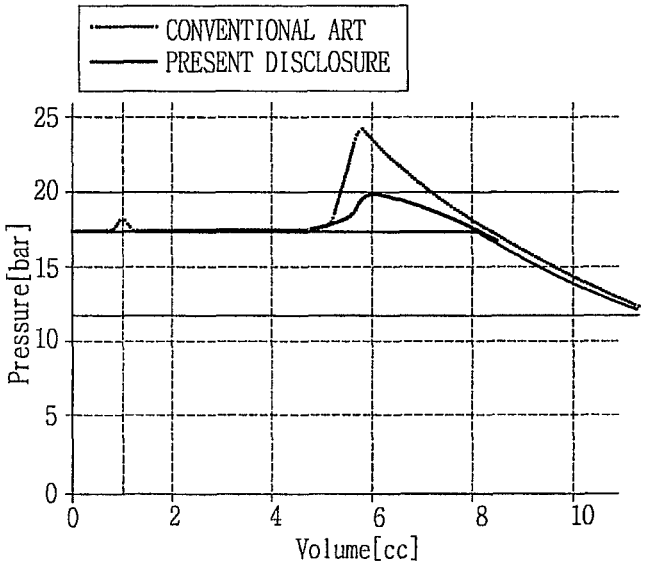

FIG. 7 is a condition table for experimenting on an over-compression loss of the scroll compressor having a pass hole of FIG. 4, and FIGS. 8 and 9 are graphs comparing an over-compression loss under the conditions of FIG. 7 with that of the conventional art.

Referring to FIGS. 7 to 9, in the conventional art where a driving speed is 45 Hz, a pressure ratio is 1.58 (an evaporator pressure is 11.22 kgf/cm2, and a condenser pressure is 17.76 kgf/cm2), a discharge pressure is about 26 bar to generate an over-compression loss of about 4 bar. On the other hand, in the present disclosure, a discharge pressure is about 24 bar to generate an over-compression loss of about 4 bar. Accordingly, in the present disclosure, an over-compression loss is lower than that of the conventional art by about 50%.

Especially, in the conventional art where a driving speed is 30 Hz, a pressure ratio is 1.49 (an evaporator pressure is 11.88 kgf/cm2, and a condenser pressure is 17.66 kgf/cm2), a discharge pressure is about 24 bar to generate an over-compression loss of about 7 bar. On the other hand, in the present disclosure, a discharge pressure is about 20 bar to generate an over-compression loss of about 3 bar. Accordingly, in the present disclosure, an over-compression loss is lower than that of the conventional art by about 40%.

When the pass hole is formed at a position overlapping with a discharge sector of the discharge hole, an over-compression of the compressor is prevented in a low speed driving mode where a driving speed is less than 45 Hz. This may enhance the efficiency of the compressor at a low speed driving mode and under a low load condition.

The aforementioned embodiment has disclosed a symmetrical type scroll compressor in which the wraps of the scrolls are symmetrical to each other with the same length. However, the present disclosure may be also applied to a non-symmetrical scroll compressor in which one of the plurality of scrolls has a wrap longer than that of another scroll. Furthermore, the present embodiment has disclosed a variable radius type scroll compressor. However, the present disclosure may be also applied to a fixed radius type scroll compressor. Still furthermore, the present embodiment has disclosed a low pressure type scroll compressor. However, the present disclosure may be also applied to a high pressure type scroll compressor.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A scroll compressor, comprising:

a hermetic container;

a driving motor provided within the hermetic container;

a fixed scroll coupled to the hermetic container at one side of the driving motor, and the fixed scroll having a first wrap on one side surface of the fixed scroll; and an orbiting scroll having a second wrap on one side surface of the orbiting scroll, the second wrap to engage with the first wrap of the fixed scroll, the orbiting scroll to perform an orbiting motion with respect to the fixed scroll, and the orbiting scroll to form a compression chamber that moves between the first wrap and the second wrap, wherein a ratio (Pd/Ps) of a discharge pressure (Pd) of a refrigerant discharged from the compression chamber with respect to a suction pressure (Ps) of the refrigerant sucked into the compression chamber is in a range of 1.5~1.8, wherein the fixed scroll includes a pass hole to pass a portion of the refrigerant, and wherein the pass hole is provided at a position of the fixed scroll where the ratio (Pd/Ps) is in the range of 1.5~1.8.

2. The scroll compressor of claim 1, wherein the pass hole is provided at the position of the fixed scroll where a sector for passing the portion of the refrigerant through the pass hole overlaps a sector for discharging the refrigerant through a discharge hole.

3. The scroll compressor of claim 1, wherein the fixed scroll further includes a discharge hole.

4. The scroll compressor of claim 1, wherein the orbiting scroll has an orbiting speed that varies based on a load.

5. A scroll compressor, comprising:

a hermetic container;

a driving motor provided at an inner space of the hermetic container;

a fixed scroll coupled to the hermetic container at one side of the driving motor, and the fixed scroll having a first wrap on one side surface of the fixed scroll;

an orbiting scroll having a second wrap on one side surface of the orbiting scroll so as to engage with the first wrap of the fixed scroll while performing an orbiting motion with respect to the fixed scroll and thereby forming a compression chamber that moves based on the orbiting motion; and a pass hole formed on the fixed scroll such that a portion of a refrigerant compressed in the compression chamber passes to outside of the compression chamber before the refrigerant reaches a discharge hole, wherein the pass hole is provided on the fixed scroll at a position where a sector for passing the refrigerant through the pass hole overlaps with a sector for discharging the refrigerant through the discharge hole, wherein the pass hole is provided at a position of the fixed scroll such that the pass hole is opened at 150°~200° and is closed at 470°~520° based on a compression starting angle.

6. The scroll compressor of claim 5, wherein the pass hole is provided at the position on the fixed scroll where a ratio (Pd/Ps) of a discharge pressure (Pd) of the refrigerant discharged from the compression chamber with respect to a suction pressure (Ps) of the refrigerant sucked into the compression chamber is in a range of 1.5~1.8.

7. The scroll compressor of claim 5, wherein the orbiting scroll has an orbiting speed that varies based on a load.

8. The scroll compressor of claim 5, wherein the first wrap of the fixed scroll is symmetric with the second wrap of the orbiting scroll.

9. A scroll compressor, comprising:

a hermetic container;

a driving motor provided at an inner space of the hermetic container;

a fixed scroll at one side of the driving motor, and having a first wrap;

an orbiting scroll having a second wrap that engages with the first wrap when an orbiting motion is performed with respect to the fixed scroll by being eccentrically coupled to a crank shaft, and thereby forming a compression chamber that moves toward a center of the fixed scroll; and a sliding member to change an orbiting radius of the orbiting scroll, wherein the fixed scroll includes a pass hole positioned such that a portion of a compressed refrigerant passes to outside the compression chamber before the refrigerant reaches a discharge hole, wherein the pass hole is provided at a position of the fixed scroll where a sector for passing the refrigerant through the pass hole overlaps a sector for discharging the refrigerant through the discharge hole, wherein the pass hole is provided at a position of the fixed scroll where a ratio (Pd/Ps) of a discharge pressure (Pd) of a refrigerant discharged from the compression chamber with respect to a suction pressure (Ps) of the refrigerant sucked into the compression chamber is in a range of 1.5~1.8, and wherein the pass hole is provided at a position of the fixed scroll such that the pass hole opens at 150°~250° and closes at 450°~550° based on a compression starting angle.

10. The scroll compressor of claim 9, wherein the orbiting scroll has an orbiting speed that varies based on a load.

11. The scroll compressor of claim 9, wherein the first wrap of the fixed scroll and the second wrap of the orbiting scroll are symmetrical to each other and have a same length.

12. The scroll compressor of claim 9, wherein the inner space of the hermetic container includes a first space to receive a suction pipe and a second space to receive a discharge pipe, and a suction side of the compression chamber communicates with the first space to which the suction pipe is connected.

13. The scroll compressor of claim 9, wherein a suction pipe is directly connected to a suction side of the compression chamber, a discharge side of the compression chamber communicates with the inner space of the hermetic container, and a discharge pipe is connected to the inner space of the hermetic container.

* * * * *